US005661515A

United States Patent [19]

Hevenor et al.

[11] Patent Number: 5,661,515

[45] Date of Patent: Aug. 26, 1997

[54] PRINTER WITH FEED FAULT DETECTION

[75] Inventors: Charles M. Hevenor, Glastonbury; Martin C. Voelker, East Hampton, both of Conn.

[73] Assignee: Gerber Scientific Products, Inc., Manchester, Conn.

[21] Appl. No.: 451,005

[22] Filed: May 25, 1995

Related U.S. Application Data

[62] Division of Ser. No. 7,662, Jan. 22, 1993, abandoned.

[51] Int. Cl.[6] ..... B41J 33/52; B41J 17/36

[52] U.S. Cl. ..... 347/215; 347/217; 400/234

[58] Field of Search ..... 347/215, 217, 347/218; 346/134, 136; 400/234

[56] References Cited

U.S. PATENT DOCUMENTS

| | | | |
|---|---|---|---|
| 4,467,525 | 8/1984 | Logan et al. . | |
| 4,496,955 | 1/1985 | Maeyama et al. . | |
| 4,512,839 | 4/1985 | Gerber . | |
| 4,618,870 | 10/1986 | Inoue . | |
| 4,671,441 | 6/1987 | Hauslaib . | |
| 4,690,577 | 9/1987 | Kikuchi et al. . | |
| 4,727,437 | 2/1988 | Mizoguchi . | |
| 4,799,172 | 1/1989 | Wood et al. . | |
| 4,804,975 | 2/1989 | Yip . | |
| 4,815,869 | 3/1989 | Van Dyck . | |
| 4,834,276 | 5/1989 | Logan . | |
| 4,899,170 | 2/1990 | Izumi . | |
| 4,910,602 | 3/1990 | Sakuragi . | |
| 4,970,531 | 11/1990 | Shimizi et al. . | |
| 4,994,822 | 2/1991 | Caine . | |
| 5,074,178 | 12/1991 | Shetley et al. | 83/47 |
| 5,110,228 | 5/1992 | Yokomizo . | |
| 5,122,882 | 6/1992 | Ishida et al. . | |

FOREIGN PATENT DOCUMENTS

| | | | |
|---|---|---|---|
| 0 561 027 A1 | 9/1993 | European Pat. Off. . | |
| 2 535 495 | 5/1984 | France . | |
| 2 582 317 | 11/1986 | France . | |
| 2 659 264 | 9/1991 | France . | |
| 8 608 803 | 6/1986 | Germany . | |
| 60203479 | 3/1986 | Japan . | |
| 0141580 | 6/1986 | Japan | 347/217 |
| 61051372 | 7/1986 | Japan . | |
| 0160871 | 7/1988 | Japan | 347/217 |
| 63-069666 | 8/1988 | Japan . | |
| 01078858 | 6/1989 | Japan . | |
| 01167145 | 9/1989 | Japan . | |
| 02108574 | 7/1990 | Japan . | |
| WO92/14122 | 8/1992 | WIPO . | |

OTHER PUBLICATIONS

Photographs of Kodak Model XL7700 film cassette (1990).

*Primary Examiner*—Huan H. Tran
*Attorney, Agent, or Firm*—McCormick, Paulding & Huber

[57] ABSTRACT

A thermal printer utilizes a donor web bearing a transfer ink to create enhanced printed images on a strip of sheet material with half-tones, color and other attractive features. The donor web is mounted on supply and take-up spools within a cassette that is removable from the printer in order to change the color or other printing characteristics of the web for various printing operations. A drag brake mounted in the printer connects with the supply spool through a disengageable coupling to maintain tension on the donor web during printing and to allow the web and cassette to be removed from the printer. A feed detection sensor in the form of an optical encoder is also contained within the printer and coupled to the supply spool through the same disengageable coupling utilized by the drag brake to detect feed faults.

2 Claims, 13 Drawing Sheets

PRINTER WITH FEED FAULT DETECTION

This is a divisional of application Ser. No. 08/007,662 of Charles M. Hevenor, et al. filed on Jan. 22, 1993 now abandoned.

BACKGROUND OF THE INVENTION

The present invention relates to a method and apparatus for making a graphic product on sheet material, More particularly, the invention relates to the making of product with enhanced graphic features through a combination of printing and cutting operations, and the equipment and the processes utilized in making of the product. The equipment and processes have many uses such as making signs, graphic designs, characters and other products with graphic images, and may be used in the field of printing for the production of visual images from data bases.

Within the signmaking field, the generation of graphic designs from a stored program is known from U.S. Pat. No. 4,467,525 entitled AUTOMATED SIGN GENERATOR and U.S. Pat. No. 4,799,172 entitled APPARATUS AND METHOD FOR AUTOMATIC LAYOUT OF A SIGN TEXT. The apparatus utilizes a cutting tool that is guided in accordance with a predetermined program to cut alphanumeric characters and other graphic images from a sheet of vinyl material that is releasably secured by a pressure-sensitive adhesive to a carrier or liner. The apparatus is controlled by a microprocessor and includes a keyboard and fonts stored in a memory to prepare sign text. Once the text has been prepared, the apparatus cuts the alphanumeric characters or other graphic designs from the vinyl and the sign text or character is stripped away from the carrier as a whole and transferred to a sign board.

U.S. Pat. No. 4,834,276 discloses a web loading and feeding system in a signmaking apparatus such as described above. The novel feeding system described is utilized to accurately position a web of vinyl material as it is loaded into a signmaking apparatus and to feed the web during the generation of the graphic images comprising the sign.

To achieve a multicolored sign or to produce three dimensional effects with the apparatus disclosed, it is necessary to cut multiple images in different colored materials and then manually overlay the graphic images cut from the colored materials. Alternatively a multi-ply layup of sign material in which different plies have different colors can be formed and cut with similar effects as more particularly described in U.S. No. Pat. 4,512,839.

In the field of printing, it is well known to produce single or multi-color images from stored data bases. For example, U.S. Pat. No. 4,618,870 discloses thermal transfer-type printer in which a plurality of colors of thermally fusible ink are transferred to a printing medium so as to produce halftone and color images. Another thermal printer for producing multi-color images is disclosed in U.S. Pat. No. 4,994,822 which utilizes a foil or web of transfer dyes in multiple colors and contains a thermal print head which is excited with pulses of different widths to control the continuous tone color in an image. U.S. Pat. No. 4,899,170 reveals still another technique for exciting the thermal print head. A related U.S. Pat. No. 4,804,975 discloses the details of a transfer dye used in a thermal printer.

U.S. Pat. No. 4,496,955 discloses another thermal printing apparatus for printing color images on a print medium by means of a thermally transferable material carried on an intermediate web. The web is provided with successive frames of respectively different colors of the thermally transferable material, and index marks along the edge of the web indicate the boundaries between adjacent color frames. A number of passes of the print medium mounted on a rotatable platen, each pass being carried out with a different colored frame of the web, permits the printing of images in the respective colors on the web. In one embodiment the web of thermally transferrable material is contained within a cassette which is received within the housing of the apparatus.

U.S. Pat. No. 5,110,228 illustrates in detail a cassette that may be used in a thermal printer for supporting a web of the thermal transfer film. The illustrated cassette has reels or spindles on which the film is wound, and a rotation prevention mechanism to prevent the film from coming loose when the cassette is removed from a thermal printer.

U.S. Pat. No. 4,815,869 is also related to the printing field, and discloses a method for printing multicolor images from computer stored information by means of a dot matrix printer.

The demand for signs and other sheet material products with multicolored or enhanced graphic images is enormous. While multicolor printing is well known in the art and producing multicolored or enhanced signs by cutting graphic images in sheet material is also well known, a merger of these arts has not been previously employed to produce enhanced graphic images. Furthermore, the convenience, flexibility and speed of producing signs and other graphic images from computer data bases offers significant advantages and substantial opportunity for improvement.

It is accordingly a general object of the present invention to provide a method and apparatus for making signs, characters, designs and other graphic products that are enhanced through color, halftone and other printed features.

SUMMARY OF THE INVENTION

The present invention resides in a method and apparatus for making a graphic product such as a sign, character, design or other graphic image on sheet material through the use of a machine readable data base. More particularly, the present invention relates to a method and apparatus that prints and cuts graphic products from a stored data base to produce enhanced images.

The apparatus, which carries out the method, includes a first storage means that stores data defining the peripheral edges of a graphic image to be generated in the product. The data stored is machine readable data. A second storage means stores the data that defines the printed material in positional relationship within the peripheral edges of a graphic image in the product. The data defining the printed material is also stored as machine readable data.

Printing means are connected with the second storage means and responds to the machine readable data to print printed material on the surface of a sheet material in positional relationship to the peripheral edges of the graphic image. Preferably thereafter, cutting means connected with the first storage means responds to the stored data for cutting the sheet material along the peripheral edges of the graphic image. The cutting is controlled in accordance with the stored data whereby graphic images containing the printed material within the cut edges of the image are prepared from the sheet material.

In one embodiment of the invention, the printing means is a thermal printer having a printing head and a roller platen over which the sheet material is fed during the printing operation. The roller platen has a cylindrical support surface and supports the sheet material adjacent the printing head for movement relative to the head during the printing operation.

In order to engage and feed the sheet material relative to the printing head, the roller platen has a width between the axial ends that is less than the width of the material on the platen, whereby a marginal edge portion of the material overlaps each axial end of the platen. Drive means engages the marginal edge portions of the sheet material at each end of the platen, and feeds the material over the platen relative to the printing head.

Preferably the sheet material has a series of feed holes along the marginal edges, and the drive means has sets of sprockets that engage the holes at each marginal edge for positive feeding of the material over the platen. The set of sprockets may be movable relative to the roller platen in a plane that is tangential to the cylindrical support surface of the platen, and when the sprockets are arranged in a circular array, they move in a cylindrical plane that is tangent to the cylindrical support surface of the roller platen but larger in diameter to provide greater contact areas with the sheet material supported on the platen.

The thermal printer cooperates with a donor web bearing a printing dye or ink that is transferred to the sheet material by the head during a printing operation. The donor web is moved relative to the head along with the material receiving the printed image so that a printing ink is. transferred to the material in accordance with the stored data.

A number of controls are employed to regulate the printing operation. For example, the pressure applied between the printing head and sheet material may be regulated as well as the spacing between the head and material so that the donor web carrying the printing ink moves with the material during printing and is disengaged from the material for slewing during non-printing phases of the operation. In one embodiment the donor web is supported in a cassette for ease of installation and removal in the printing means. The cassette carries a code that is read by the printer in order to regulate various parameters of the printing operation such as the pressure between the head and the sheet material, the speed of the printing operation or the excitation of the head of printer. Detectors for signaling the absence of material and jams render the printing operation more secure.

As a result of the invention, signs, characters, designs and other graphic images can be produced in multiple colors or halftones and with other printing features which significantly enhance the images.

DESCRIPTION OF THE PREFERRED EMBODIMENTS

Figure 1:
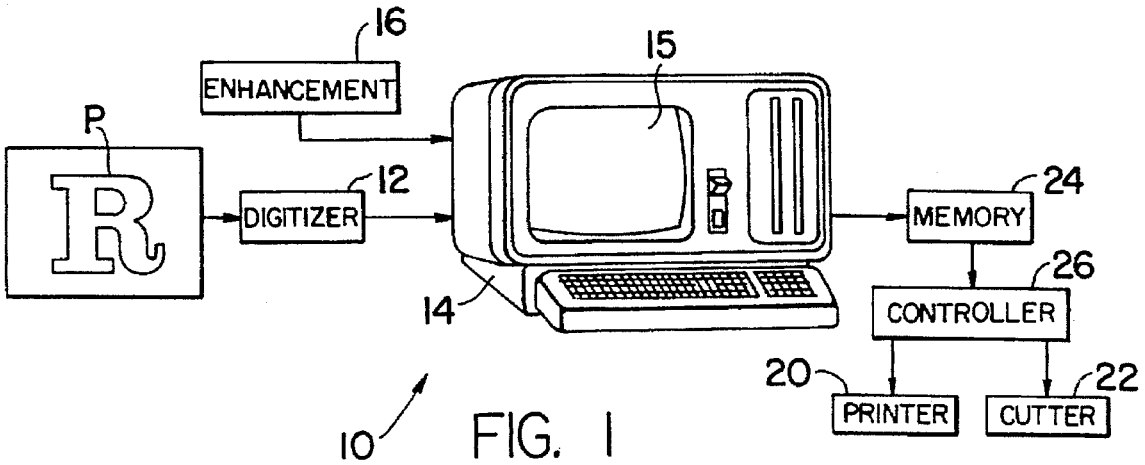
FIG. 1 is a schematic diagram illustrating a system for printing and cutting signs and other graphic products in accordance with the present invention.

FIG. 1 illustrates a microprocessor based system, generally designated 10, having apparatus for making signs, characters, designs and other graphic products with enhancements provided by the addition of color, halftones and other printed features.

Figure 2:
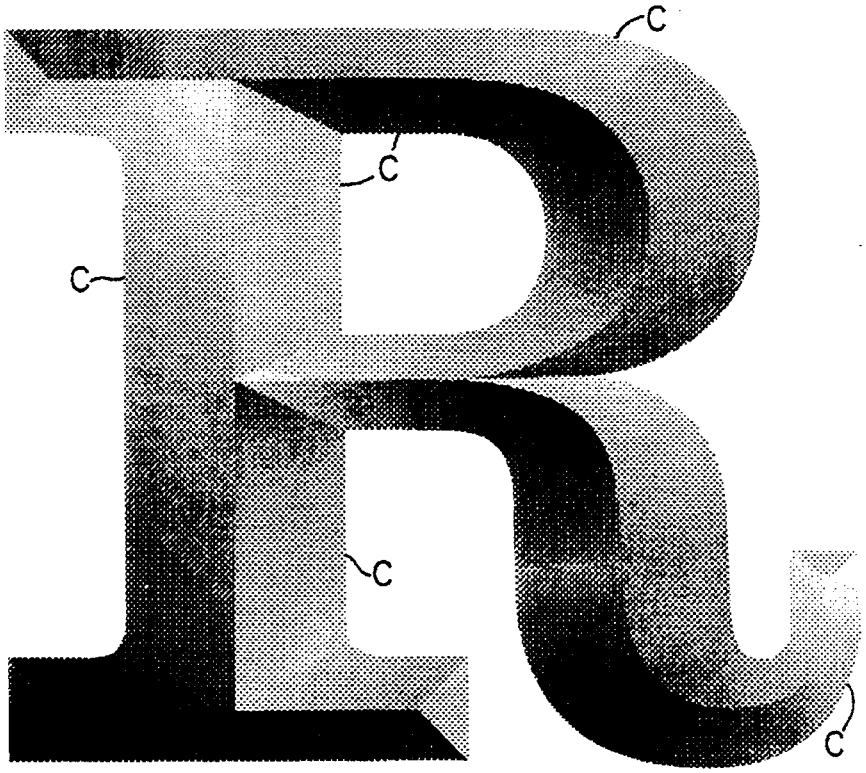
FIG. 2 is a three dimensional halftone image of the letter "R" that can be produced in accordance with the present invention.

For example, the letter "R" shown in FIG. 2 has printed halftone characteristics which imbue the letter with a three dimensional character. Such printed enhancements of the letter are quite distinctive and when such letters are cut along the peripheral edges C from a sheet material such as a vinyl sheet which can withstand weather, wear, abuse and other hazards rather well, a very attractive sign or other graphic product is generated.

Figure 3:
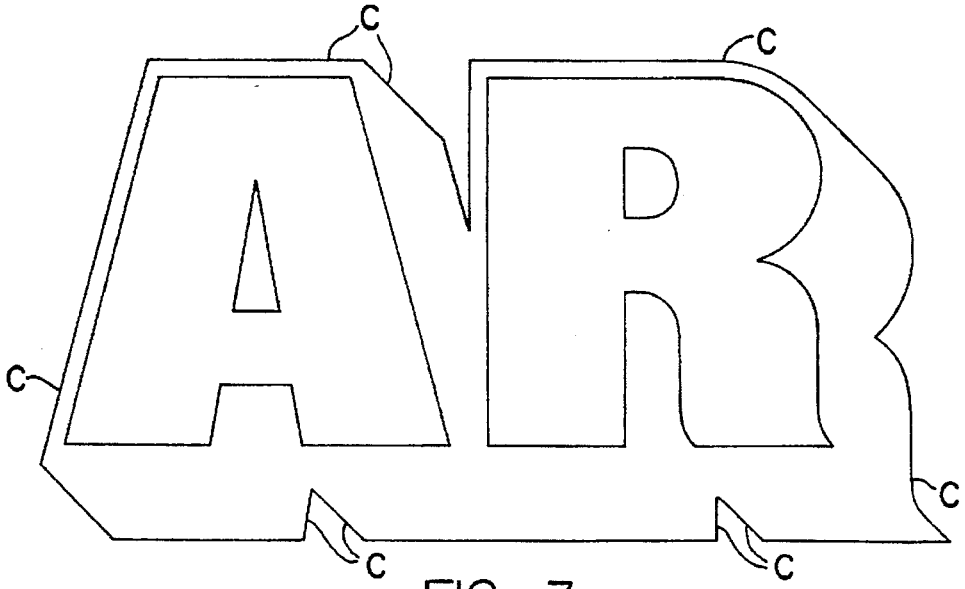
FIG. 3 is a three dimensional image of the letters "AR" that can be produced in accordance with the present invention.

Similarly, the letters "AR" shown in FIG. 3 can be prepared in two dimensional form on a single sheet of vinyl or other material with a three dimensional character by using different colors for the face of the letters and the shadow or third dimension.

The system disclosed in FIG. 1 enables a graphic product to be created and produced with enhancements from a data base on which both the printed and cut features of the product are commonly based. To produce a graphic product with enhancements, the system 10 includes a digitizer 12 or other data input device which supplies a microprocessor based or other computer 14 with machine readable data defining at least the peripheral edges of the graphic product and possibly internal edges as well. The computer 14 displays the machine readable data defining the edges as an image on the screen 15. Then printed enhancements from the special enhancement programs in memory 16 printing designs are added within the edges of the displayed image with the aid of the computer as the operator or composer desires. All the edge and enhancement features are the referenced to one another in a common data base. For example, the enhancement features may include special programs that allow halftone images such as the halftone features shown in FIG. 2 to be added within the peripheral edges of the pattern P.

Alternatively, the memory 16 may include an entire font of halftone or otherwise enhanced characters including the edge data, in which case the data input to the computer 14 for the purposes of preparing a final product may be selected entirely from the memory. Still further, the digitizer may serve as the sole input device and may provide the critical data points defining the peripheral edges to be cut as well as the edges of the printing as in the enhanced letters "AR" shown in FIG. 3. Still other data sources may be utilized to supply the computer 14 with an infinite variety of graphic images with enhancements that can be produced by the system 10.

From the data defining the enhanced graphic product, the computer 14 generates at least one printing program for operating a printer 20 that prepares one portion of the enhanced graphic product, and a cutting program that operates a cutter 22 and prepares the remaining portion of the product. Additional printing programs may also be generated, for example, to prepare additional printed material in different colors. Each program is stored in a memory 24, and when the product is to be produced, a controller 26 reads they programs and operates the printer 20 and cutter 22 respectively.

For example, to create the graphic image of the letters "AR" in FIG. 3, the outline of the letters and the shadow of the third dimension are printed by the printer 20 on a sheet material, such as a vinyl secured by a pressure sensitive adhesive on a releasable backing material. One such vinyl is sold by the Assignee of this application under the trademark SCOTCHCAL of 3M Company. The printer prints the outline of the letters and third dimension in black or another color contrasting with the basic color or colors of the vinyl material. The printed sheet of vinyl on the releasable backing material is then mounted in the cutter 22 and the controller 26 cuts the vinyl only along the peripheral edges C of the image and any internal edges in accordance with the cutting program in the memory 24.

By utilizing a printing program and cutting program which have a common data base for defining both the peripheral edges to be cut as well as the printed material, the printing and cutting operations on the sheet of vinyl material are coordinated. After weeding to remove unwanted vinyl material within or around the image, the vinyl forming the enhanced graphic image is lifted from the underlying backing material and is attached to a sign board, window or other object.

It is generally preferable, but not essential, to carry out the printing operation in the printer 20 before the sheet material is cut by the cutter 22. With a separate printer and cutter it is also essential that the graphic image that is printed on the vinyl be registered in the cutter with the printing program origin and the cutting program origin coincident. In this manner the lines of cut and the printed portion of the image maintain the correspondence established by the common data base. This registration can be accomplished by printing an origin point on the vinyl along with the printed portion of the image and then optically aligning the origin point with a reference position for the material in the cutter 22. If the printing and cutting operations are carried out by a single machine or a machine having a common drive mechanism for positioning the vinyl relative to a printing head and a cutting head, then the origin point or other reference can be eliminated.

A unique printing apparatus for carrying out the printing operation is described in further detail below. A suitable cutting apparatus for carrying out the cutting operation on sheets of vinyl or other material is described in the above-referenced U.S. Pat. Nos. 4,467,525; 4,799,172 and 4,834,276, all owned by the Assignee of the present application.

Figure 4:
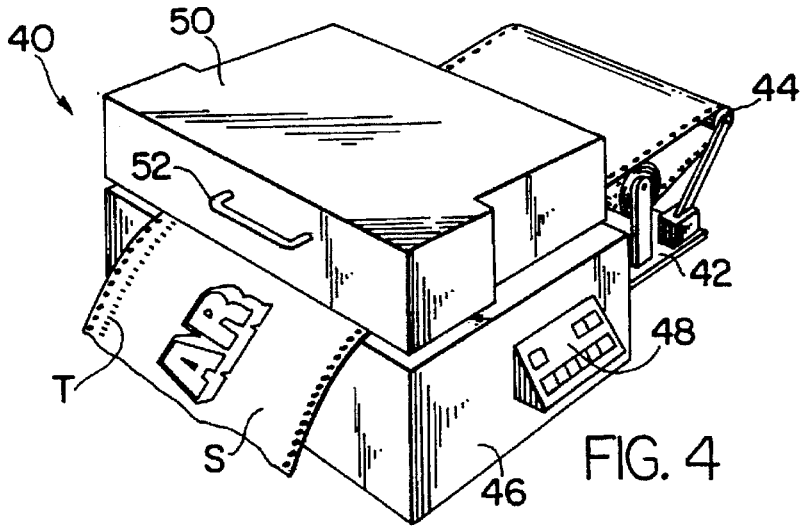
FIG. 4 shows one embodiment of a thermal printer that may be utilized in the present invention.

One embodiment of a printer for accomplishing the printing operation disclosed in FIG. 1 is illustrated in FIG. 4. The printer 40 utilizes a set of sprockets to engage corresponding feed holes extending along each longitudinal edge of a strip S of the sheet material from which the graphic product is prepared, and correspondingly the cutter 22 has a set of sprockets to engage the same series of feed holes during the cutting operation. In this manner the registration of the cut edges of the graphic with the printed image is insured in the longitudinal direction. Since the graphic image is absolutely fixed both transversely and longitudinally on the strip S relative to the feed holes, the feed holes become a proper reference for the image in both the printing and cutting operations.

Alternatively, the printer can prepare a positional reference track T on the print-receiving surface of the sheet material to establish a known positional relationship between the printed image on the strip S and the strip itself. The cutting operation is then carried out by the cutter after the printing operation, and the cutter reads the positional reference track on the sheet material in order to coordinate the position of the material and the cutting tool with the printed material.

As shown in FIG. 4 the strip S is supplied in a roll which is supported on a platform 42 at the back side of the printer and is fed over a guide roller 44 before it enters the housing 46 of the printer. After the strip passes through the printer where the printing operation takes place, it is discharged freely at the front side of the machine or may be retrieved on a take-up reel if desired.

Although the printer 40 is connected for controlling the printing operation to the controller 26 in FIG. 1, the printer includes a control panel 48 on the housing 46 to stop and start printing operations. Additionally the control panel 48 includes controls for slewing the strip S independently of the printing operation and other controls for operating the printer as will become more apparent hereafter.

The upper portion of the printer 40 has a cover 50 with a handle 52 that can be opened and closed in order to expose the internal structure of the printer as shown more particularly in FIGS. 5–10.

Figure 8:
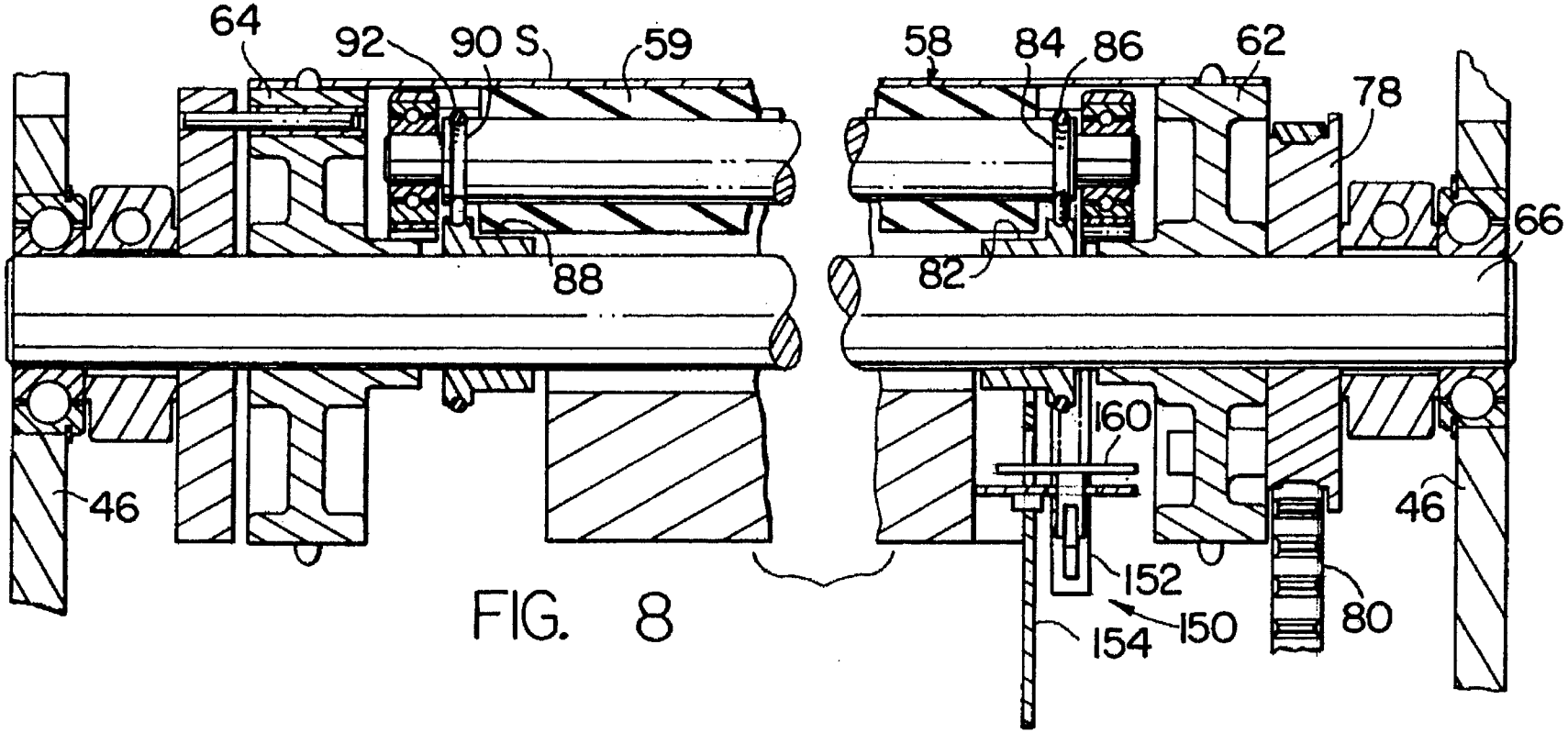
FIG. 8 is a fragmentary front view showing the support structure and drive mechanism for the roller platen and drive sprockets.

Within the printer 40, the strip S passes over a roller platen 58 relative to a thermal print head 60 which is pressed downwardly onto the strip of material and generally establishes a linear zone of contact between the material and the platen. In one embodiment the strip of vinyl sheet material is 15" wide and a hard rubber sleeve on the roller platen as well as the print head are approximately 12" wide. Thus a marginal edge portion of the strip overlaps the rubber sleeve 59 of the roller platen at each end as indicated in FIG. 8. A drive sprocket 62, having a set of sprocket pins engages a series of feed holes along the one marginal edge of the strip S, and a similar drive sprocket 64 having sprocket pins engages a series of feed holes along the opposite marginal edge of the strip. For a more complete description of the series of feed holes and drive sprockets reference may be had to U.S. Pat. No. 4,834,276 mentioned above.

Figure 6:
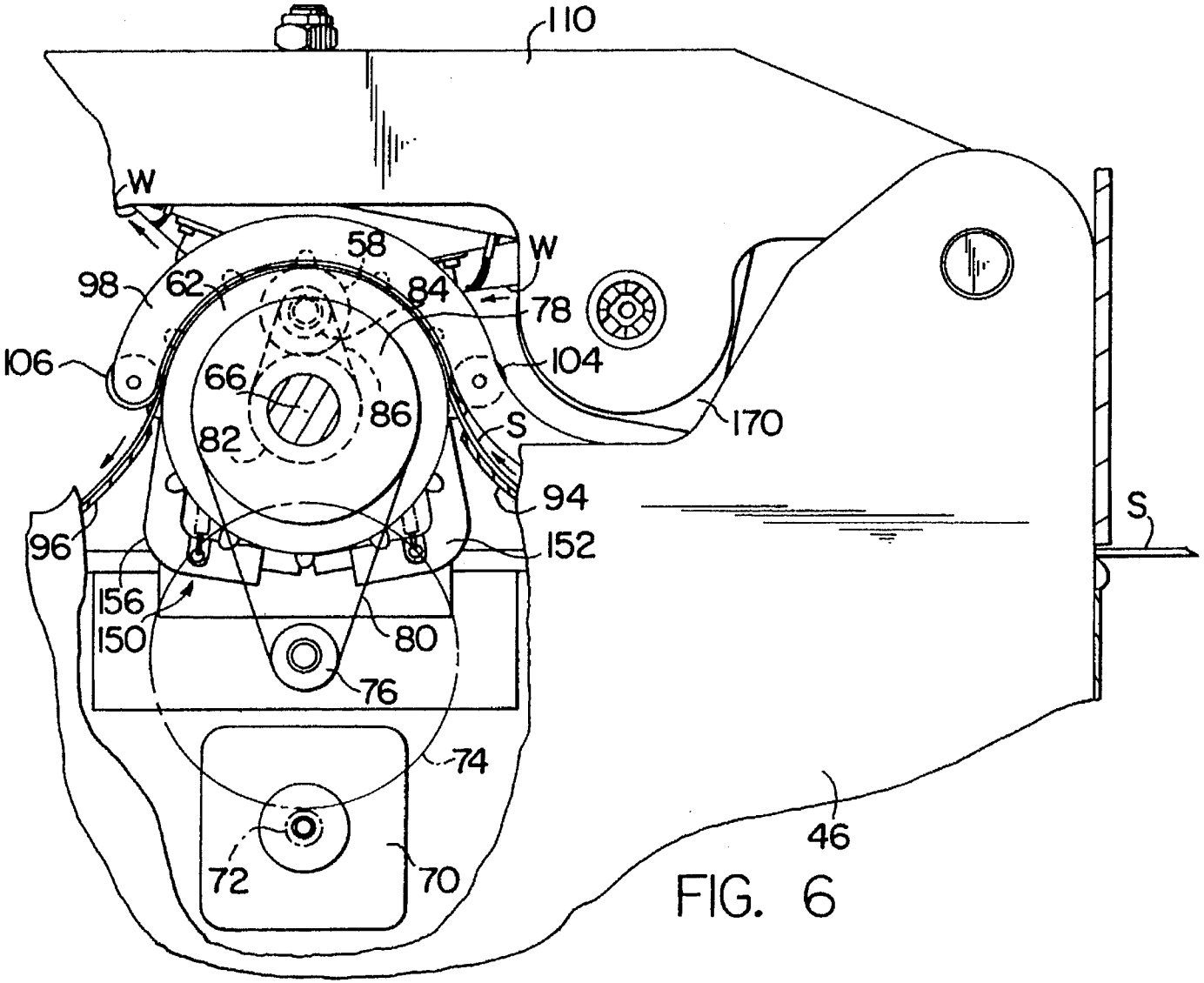
FIG. 6 is an enlarged fragmentary view of the printer as shown in FIG. 5 and shows the drive mechanism for moving a strip of sheet material relative to the print head.

As shown in FIGS. 6 and 8, the drive sprockets 62,64 are fixedly mounted to a drive shaft 66. The drive shaft is rotatably mounted within the housing 46 of the printer and is driven from a step motor 70 by a series of drive gears 72,74, toothed drive pulleys 76,78 and a toothed drive belt 80. In addition the roller platen 58 which is also rotatably mounted within the housing 46 is driven from the drive shaft 66 by means of drive pulleys 82,84 and an O-ring drive belt 86 at one end of the platen and drive pulleys 88,90 and an O-ring drive belt 92 at the opposite end of the platen. The gears, pulleys and toothed drive belt 80 ensure that the strip S of sheet material is precisely positioned on the roller platen and control the speed at which the strip S moves through the printer. The drive pulleys 82,84, 88,90 are selected to establish a peripheral speed of the roller platen 58 that is slightly higher than the peripheral speed of the drive sprocket 62 and 64 to augment the feeding of the strip S past the print head 60. Since the drive sprockets positively engage the strip and control the speed of the strip, the O-ring drive belts 86,92 must allow limited slip.

As shown most clearly in FIG. 6 a pair of curved, sheet metal plates 94,96 guide the strip S of sheet material circumaxially onto and off of the roller platen 58 and the cylindrical surfaces of the sprockets 62,64 in a U-shaped feed path. The cylindrical surfaces of the sprockets lie in a cylindrical plane which is much larger in diameter than the cylindrical, strip-engaging surface of the roller platen 58 and is tangential to the cylindrical surface. Preferably the cylindrical surface of the platen is formed by a hard rubber sleeve which improves the frictional engagement of the platen with the releasable backing material of the strip.

Figure 9:
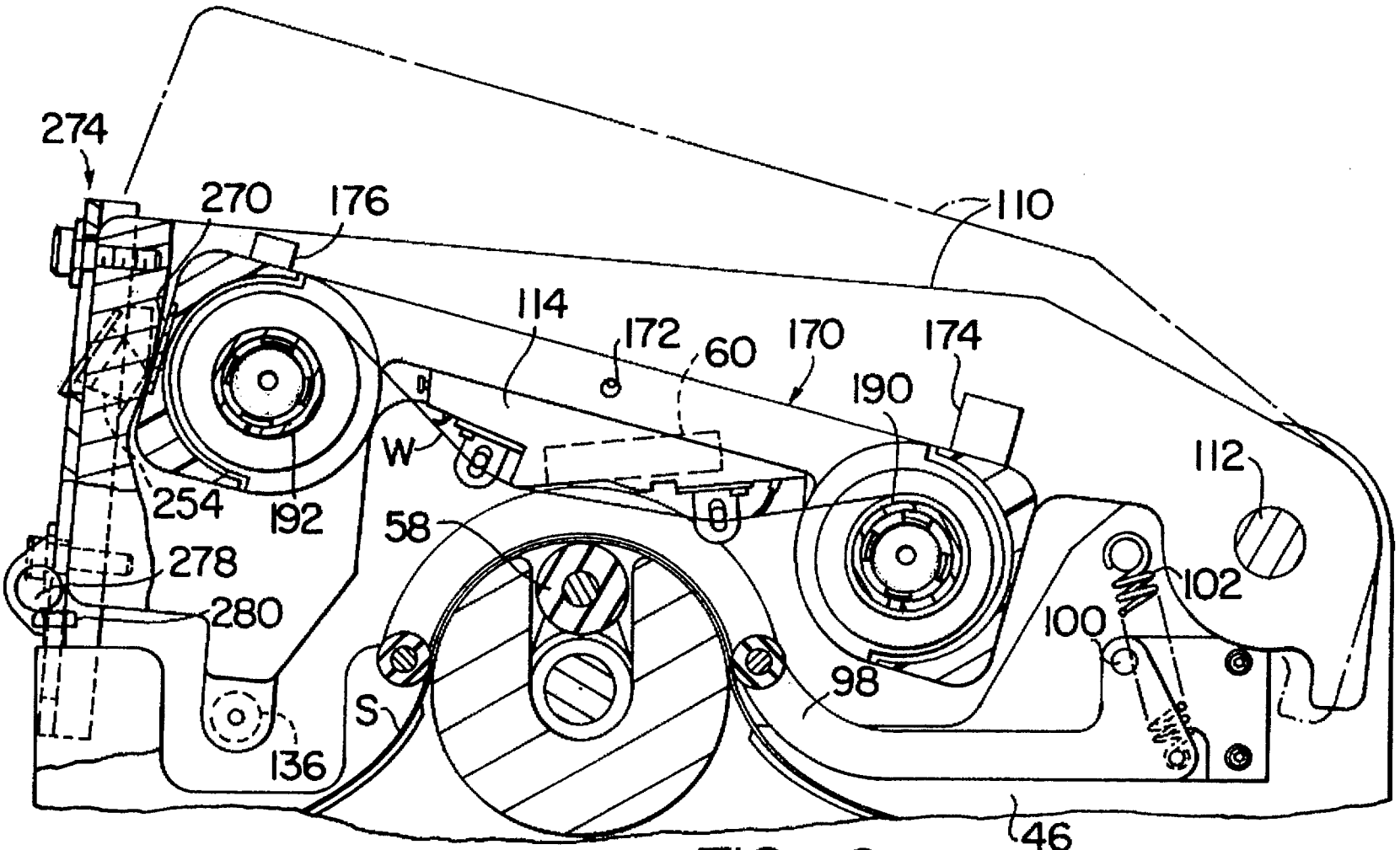
FIG. 9 is another side elevation view showing the cassette supporting the donor web with the printing ink and the code reader before reading the code for the donor web.

To keep the strip S fully engaged with approximately 180° of the sprockets 62,64, a pair of holddown bails 98 straddle the pins of each sprocket. The bails are pivotally suspended from the housing 46 on pins 100 as indicated in FIG. 9 so that the bails can be lifted away from the sprockets and allow a strip of sheet material to be mounted on and removed from the sprockets and roller platen 58. Over-center springs 102 assist in holding the bails downwardly on the strip and also permit lifting the bails away from the sprockets during installation or removal of a strip. In addition a pair of holddown rollers 104,106 in FIG. 6 extend between the bails 98 at the supply and discharge points from the roller platen. Thus, the series of feed holes along each edge of the strip S are threaded onto the sprockets 62 and 64 by lifting the bails, and are held firmly engaged with the sprockets and the roller platen by lowering the bails.

Figure 5:
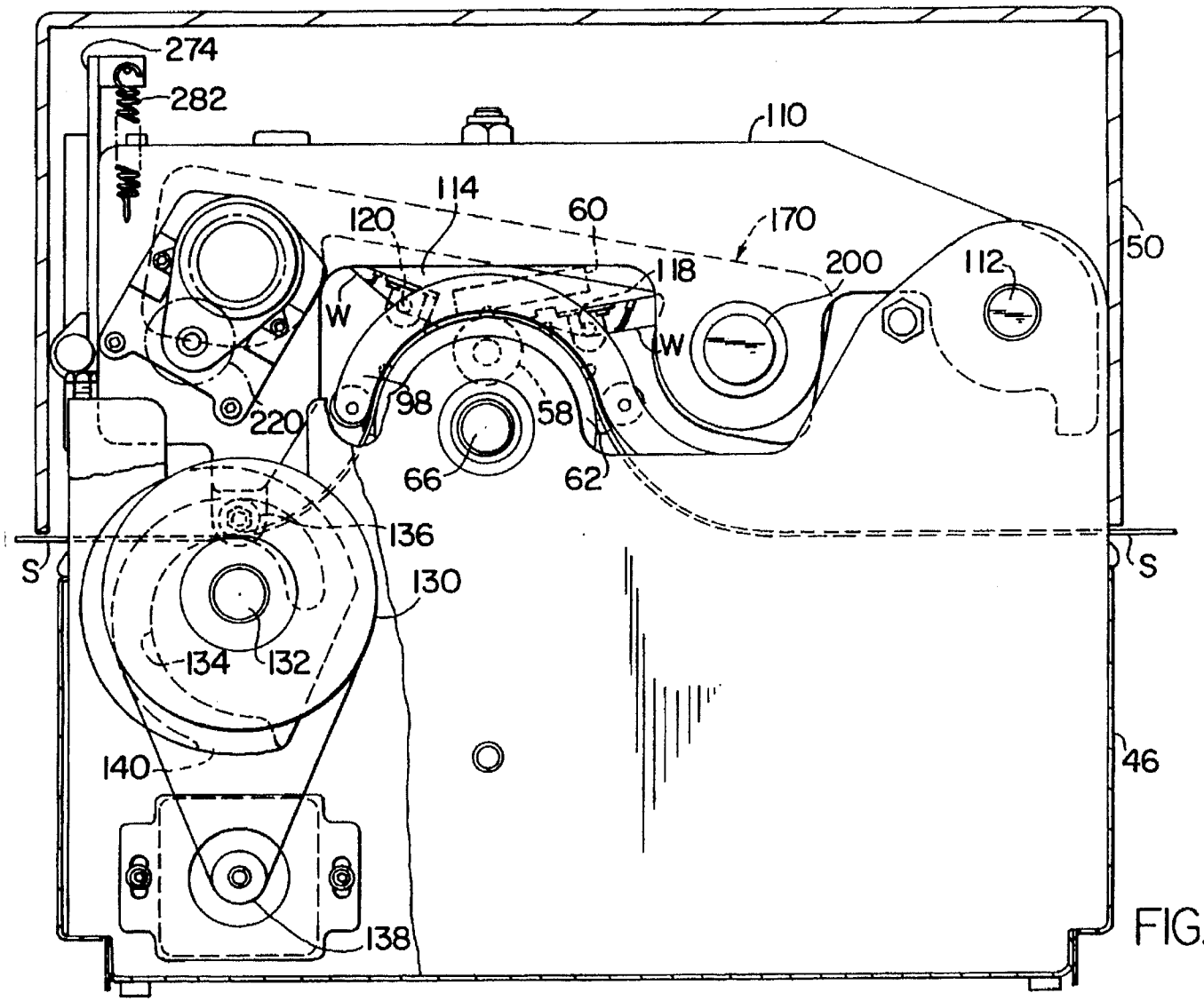
FIG. 5 is a side elevation view of the thermal printer in FIG. 4 with portions broken away to show the internal structure.

The thermal print head 60 is mounted in an upper support frame 110 that is pivotally mounted on an axle 112 at the back side of the housing 46 as shown in FIGS. 5, 6 and 9. In FIG. 9 the support frame is shown in phantom at a partially elevated position. The actual suspension of the thermal print head 60 from the support frame 110 is illustrated in detail in FIG. 7. A suspension plate 114 is connected with the frame 110 by means of a series of bolts 116 which are secured to the plate 114 and slideably received within the frame 110 so that the plate 114 together with the print head 60 can move vertically in FIG. 7 relative to the support frame. Surrounding each of the sliding bolts 116 and interposed between the frame 110 and plate 114 is a coil spring 117 which applies pressure downwardly to the plate 114 and presses the print head 60 against the strip S of sheet material and the roller platen 58 along a line of contact. The print head 60 has a plurality of heating elements distributed evenly along the head from one end of the roller platen 58 to the other, and the heating elements a densely packed along the line of contact preferably with a density of 300 elements per inch. One such a head is made by Kyocera Industrial Ceramics, Inc. of Kyoto, Japan.

In addition to supporting the thermal print head 60, the mounting plate 114 also serves as a heat sink for the heat generated in the print head and supports a pair of dancer rolls 118,120 which guide a web or foil W over the head. The web bears a heat sensitive printing ink or printing dye in black, white or other colors on the surface of the web facing the strip S of sheet material.

The web W bearing the printing ink is interposed between the print head 60 and the strip S of sheet material, and when the heating elements of the head 60 are selectively energized, the portion of the ink immediately under a heating element is released from the web and transferred to the sheet material. With high density heating elements, graphic images of high resolution are thus created on the strip of sheet material. The excitation of the heating elements is, of course, controlled in accordance with the program of printed material that is read by the controller 26 from memory 24 in FIG. 1.

The web W of printing ink has a width substantially equal to that of the print head and is moved synchronously with the strip of sheet material relative to the head by virtue of the pressure applied between the print head and the roller platen 58. As the web W moves, a pair of static suppression brushes 122,124 mounted in the plate 114 wipe the side of the web opposite from the printing ink. With the drive sprockets 62 and 64 having a larger diameter than the roller platen 58, the roller platen defines a relatively thin line of contact with the strip S of sheet material and yet the sprockets can engage an inverted U-shaped segment of the strip which is substantially larger than the segment contacting the hard rubber sleeve of the roller platen. This allows a narrow linear zone of high pressure contact to be made by the strip with the printing head while a dispersed area of contact with the strip is provided for driving the strip.

Figure 7:
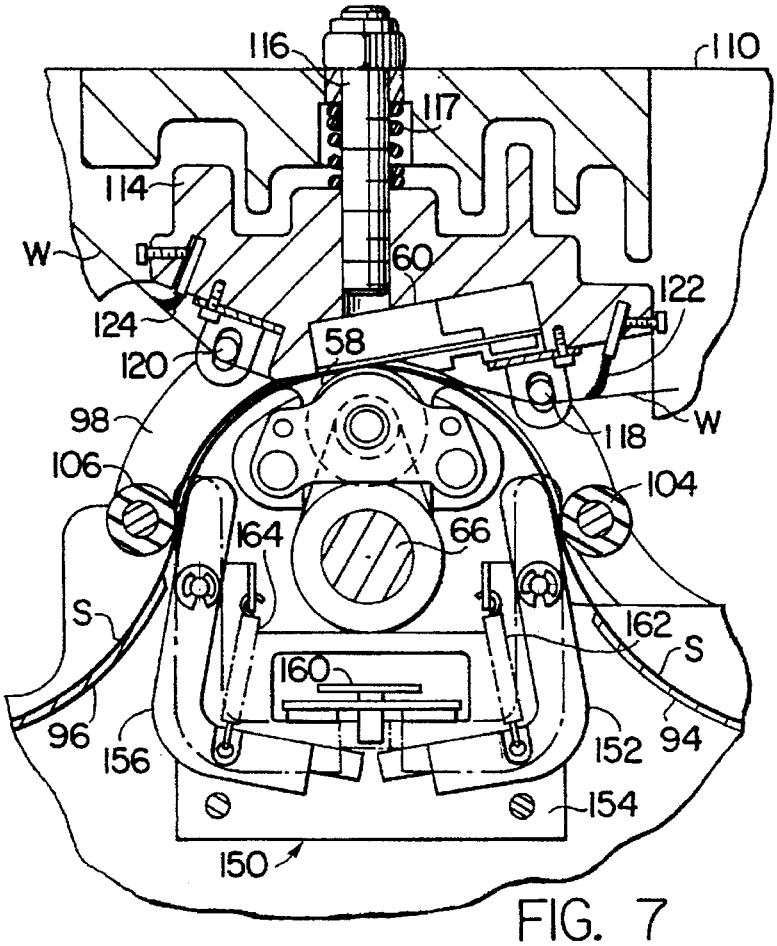
FIG. 7 is an enlarged fragmentary view of the printer similar to FIG. 6 and shows the print head, roller platen and sheet material detector.

In order to regulate the amount of pressure applied to the web W and strip S by the head and the roller platen, the projecting or cantilevered end of the support frame 110 is moved up and down relative to the platen 58 by a pressure regulating mechanism that is adjusted by the controller 26. The pressure regulating mechanism includes one or more cams 130 shown in FIG. 5 which are rotatably mounted in the housing 46 on a shaft 132. The cam 130 includes a spiral cam slot 134 that is engaged by a cam follower 136 connected to the projecting end of the support frame 110. As the cam 130 is rotated by means of the pressure regulating step motor 138, the cam follower together with the support frame 110 move up and down and the pressure applied to the web W and strip S of sheet material between the print head 60 and roller platen 58 is adjusted through the coil springs 117 (FIG. 7). By controlling the rotation of the cam 130 with the step motor 138, a precise pressure setting can be obtained since the displacement of the support frame is directly proportional to the pressure.

The spiral cam slot 134 includes an exit point 140 at the periphery of the cam 130 so that the cam follower and correspondingly the support frame 110 can be lifted completely free of the cam when the cam has rotated to the upright position. The controller 26 may thus regulate the position of the cam to permit or prevent the lifting of the support frame 110 and print head 60 at appropriate times in a printing operation.

The pressure regulating mechanism can also be utilized to lift the pressure head out of contact with the strip S and roller platen since the spiral cam slot 134 is comprised by a groove that can both push and pull the cantilevered end of the support frame 110 up and down. Thus, for example, at the end of a printing operation the regulating motor 138 can drive the cam 130 to a position at which there is zero pressure between the print head and the roller platen or the print head can actually be lifted away from the roller platen so that the strip S of sheet material can be slewed back and forth relative to the print head without making contact with the web W of printing ink.

The lifting feature of the pressure regulating mechanism is desirable when, for example, multiple colors are printed on the strip S of sheet material in multiple passes of the material over the roller platen relative to the head. Between each pass the web W must be changed or indexed so that printing inks of different colors can be transferred from different webs or different portions of one web onto the same segments of the strip S in overlapping, side-by-side or spaced relationship. The ability to overlap the colors is particularly useful when subtractive inks or color process dyes are employed to mix the colors and obtain still further colors.

The pressure regulating step motor 138 may also be adjusted by the controller 26 of FIG. 1 in accordance with other printing parameters of the operation. For example, the texture or character of the printing-receiving surface on the strip S of sheet material may require setting the pressure at a preferred level for ideal transfer of the ink between the web W and the strip S. Other parameters that may effect the desired pressure level include the speed at which the printing operation is carried out, the character or color of the printing ink that is transferred from the web W and the intensity or tone of the printed material desired on the strip. The adjustment of the pressure level can occur prior to or throughout the printing operation in accordance with print characteristics that are stored in the print program or are measured during the printing operation.

Since the strip S of sheet material may be slewed back and forth between opposite sides of the roller platen 58 and operation of the head without material on the platen can cause serious damage to the head or platen, it is desirable to be able to detect the absence of the strip at each side. For example, if the trailing end of the strip S passed over the roller platen in the course of a printing operation, the web of printing ink would be caused to make direct contact with the roller platen and the ink together with the heat from the printing head may actually cause damage to the head. Correspondingly, if the strip S is slewed backwards to begin a second printing operation on the same segment of the strip with, for example, an ink of a different color, the leading end of the strip may pass beyond the roller platen and again the web W and printing head may be pressed directly against the cylindrical surface of the roller platen. Accordingly a strip detector 150 shown in FIGS. 6 and 7 is provided at both the input and discharge sides of the roller platen to detect the absence of the strip at each location.

The detector 150 includes a first detector arm 152 that is pivotally mounted on a plate 154 at the input side the roller platen, and a second detector arm 156 pivotally mounted to the plate at the discharge side of the roller platen. The upper ends of the arms project into the feed path of the strip S through slots in the guide plates 94 and 96 respectively. Thus when the web is present at the input side the detector arm 152 is depressed and assumes the solid line position illustrated in FIG. 7, and when the web is present at the discharge side the detector arm 156 is depressed and assumes the solid line position. In the solid line positions of the arms 152 and 156, the depending end of the arms are drawn out of contact with an actuating switch 160 which may be a microswitch. However, when the strip S is not present at the input side, the detecting arm 152 is rotated inwardly at the bottom by the retracting spring 162 to the phantom position, and the switch 160 is actuated to signal the absence or an error in the positioning of the strip S. Correspondingly when the web is not present at the discharge side of the roller platen 58, the retracting spring 164 draws the arm 156 inwardly to the phantom position, and correspondingly actuates the switch 160. Thus it is possible to detect the absence of the web at either side of the roller platen and send a warning signal to the controller 26 of FIG. 1 through the single switch 160.

As mentioned above the web W bearing the printing ink that is transferred by the printing head 60 is moved with the strip S relative to the printing head during a printing operation and the ink is transferred from the web onto the sheet material. As a consequence the web is a donor web that is expended normally after a single use and therefore must be periodically replaced. Furthermore, the webs generally include a transfer ink of a single color, and in order to print graphic images in multiple colors, it is necessary to run the printing operation one or more times with different webs and printing inks. For this reason the preferred embodiment of the invention incorporates a web that is supported in a replaceable cassette 170 shown in the installed position in FIGS. 5, 6, 9 and 10. The cassette 170 is held in an operative position within the support frame 110 by means of a pair of oppositely disposed mounting pins 172 (only one visible) and by blocks 174,176 which establish a reference plane within the frame 110. The cassette is easily installed and removed from the frame when the frame is lifted to a fully open position.

The cassette 170 by itself is shown more clearly in FIGS. 13–16 and includes two molded side rails 180,182 and two end shells 184,186. This construction provides the cassette with a generally rectangular configuration and the central portion of the rectangle between the side rails 180 and 182 defines an opening through which the printing head 60 and support plate 114 may pass in order to press a donor web mounted in the cassette onto the roller platen as shown, for example, in FIG. 9. One end of the donor web W is mounted on a spool 190 enclosed within the end shell 184 and the other end is mounted on a spool 192 enclosed by the end shell 186.

At each axial end the spool 190 is supported loosely within a pair of aligned holes at one side of the side rails 180 and 182 respectively, and correspondingly the spool 192 is loosely supported at its axial ends within another pair of aligned holes at the other end of the side rails 180,182. The loose mounting of the spools in the side rails allows each of the spools limited freedom of movement in the radial direction relative to the common axis that connects the aligned holes in the side rails. Additionally, as shown most clearly in FIG. 16 each spool 190,192 includes at least one axial end a set of teeth projecting radially outward while the side rail at the same end of the spool includes another set of teeth projecting radially inward. The limited movement of the spools in the radial direction allows the teeth on the spool and the side rails to become engaged which thereby inhibits spool rotation and prevents the web of material from unraveling when the cassette 170 is removed from the thermal printer. When the cassette 170 is mounted in the printer, each of the spools is held in alignment with the common axis and with the teeth disengaged as explained further below. Thus the spools are permitted to rotate freely under the control of the printer.

Figure 11:
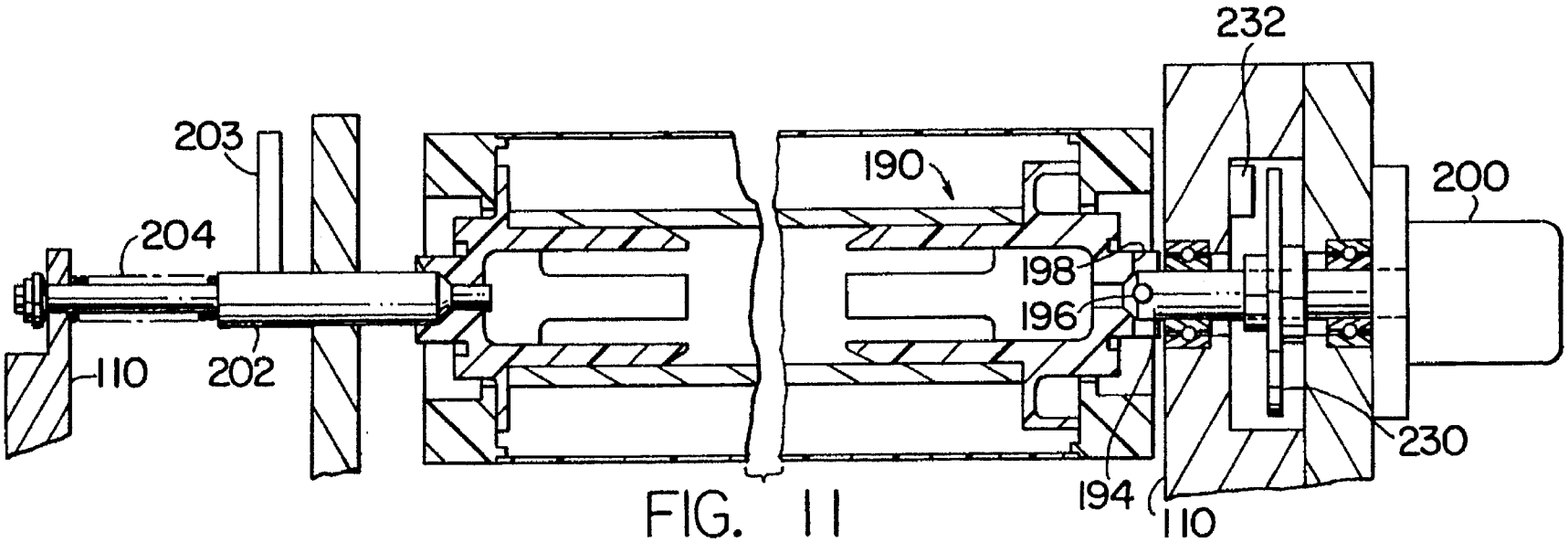
FIG. 11 is a fragmentary view showing the support structure for the supply reel in the cassette containing the donor web.

When the cassette is mounted in the support frame 110 as shown in FIG. 11, one axial end of the spool 190, which is the supply spool, is mounted on a rotatable axle 194, which centers the spool within the mounting hole in the cassette and is coupled to the axle by means of a cross pin 196 that is received within slots 198 of the spool. The end of the axle opposite from the cross pin 196 is coupled to a slip clutch or drag brake 200 to impose frictional restraint on the supply spool as the donor web W is pulled off of the spool. The opposite end of the spool 190 is captured on a non-rotatable axle 202 to center the spool within the mounting hole of the cassette. The axle 202 is also movable axially of itself and is biased into engagement with the spool 190 by means of a compression spring 204. Thus by depressing a release lever 203 and retracting the axle 202, the spool 190 is released from the mounting frame 110.

Figure 12:
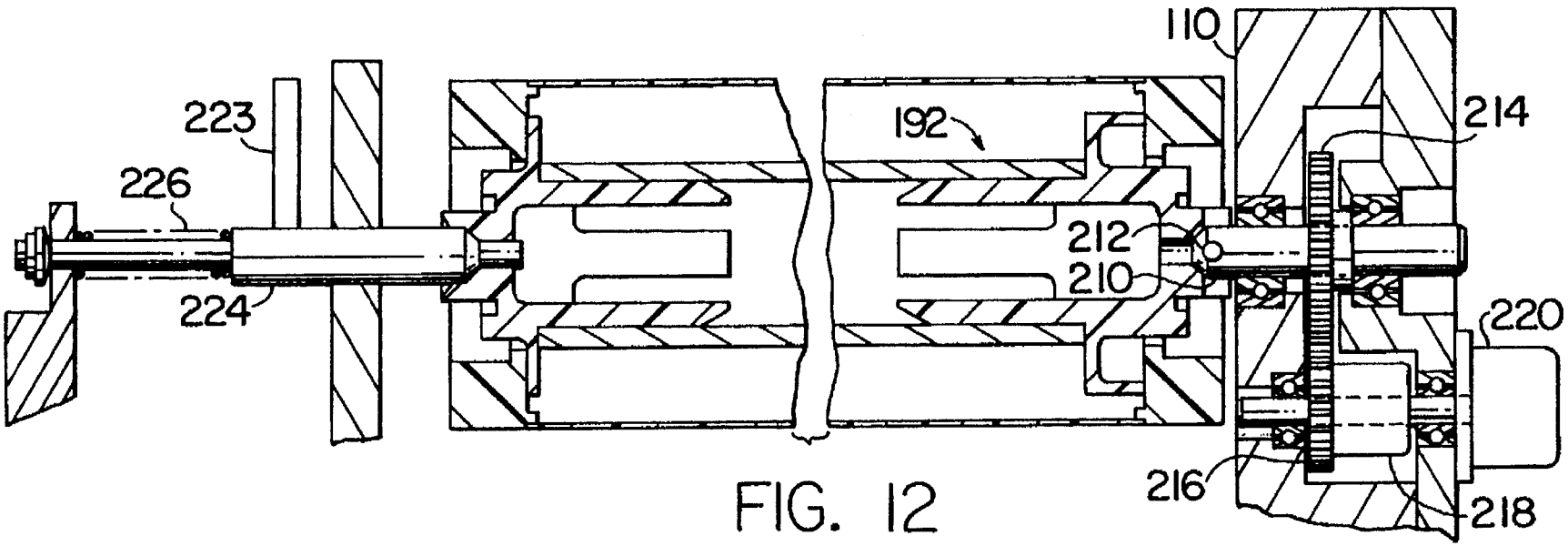
FIG. 12 is a fragmentary view illustrating the drive mechanism for the take-up reel in the cassette containing the donor web.

The spool 192 is considered the take-up spool and takes up the consumed portion of a donor web in the course of a printing operation. As shown in FIG. 12, the one end of the take-up spool 192 is mounted on a rotatable axle 210 which centers the spool and is drivingly engaged with the axle by means of the cross pin 212. The axle 210 is connected through a set of gears 214,216 and a slip clutch 218 to a drive motor 220. Thus, when the drive motor is engaged it applies a torque which is limited by the slip clutch 218 to the take-up spool 192 and thus produces a uniform tension force on the donor web W. The drive motor 220 is engaged only during a printing operation and the force applied to the donor web is so limited by the slip clutch 218 that the actual movement of the web is controlled by the movement of the rotatable platen 58. Thus the web W and the strip S of sheet material which are pressed between the print head 60 and the roller platen 58 move synchronously relative to the printing head during a printing operation. When the pressure between the print head and roller platen is released, for example, during slewing of the strip S, the drive motor 220 is de-energized and the web W does not move and is not consumed.

The end of the take-up spool 192 opposite from the drive motor 220 is mounted and centered on a non-rotatable and axially retractable axle 224 with a release lever 223 in the same manner as the spool 190. The axle 224 is pressed into engagement with the spool by the compression spring 226.

It should be understood that with the spools 190 and 192 positioned loosely within the cassette 170, and the frame or casing of the cassette held in the printer by means of the. registration pins 172 and reference blocks 174,176 as shown in FIG. 9, the positioning of the spools and correspondingly the donor web W is controlled within the printer by axles 194,202, 210 and 224 while the position of the casing is controlled independently by the registration pins 172 and the reference blocks 174,176. However, when the casing and the spools are mounted, the spools are free to rotate within the enlarged holes of the cassette without interference from the locking teeth.

As shown in FIG. 11, an optical encoding disk 230 is coupled to the rotatable axle 194 that engages the supply spool 190. An optical reader 232 is mounted on the support frame 110 immediately adjacent the encoding disk 230 so that the rotation of the axle as well as the supply spool can be detected during a printing operation. The reader 232 produces a signal indicating that the donor web W is in motion as it should be during the operation. If the signal indicates no movement when there should be movement, such a signal means that the supply spool 190 is empty or that the donor web W alone or together with the strip S of sheet material is jammed and not moving properly past the print head 60. In either event the lack of movement indicates a fault of the printing operation and the controller 26 which receives the signal from the reader 232 stops the printer and issues a fault signal.

As indicated above, a printing operation may be carried out to produce printed material in various colors, and generally the entire printing and cutting operation for making a sign or other graphic product is pre-programmed, not only with respect to the design and arrangement of the printed matter within the peripheries of the graphic product, but also the colors of the print and the sheet material on which the print is placed. Accordingly, in order to carry out a printing operation properly, the operator of the printer must install both the strip of sheet material and a cassette that is called for by the program.

Additionally, the materials on which the printing takes place as well as the donor webs used in the printing process may have different printing characteristics beyond just color which render the materials incompatible or the resulting product inferior unless the printer is controlled and adjusted properly to compensate for the different characteristics. For example, the pressure applied between the donor web and strip of sheet material may need to be adjusted up or down in accordance with the donor web that is being used in a printing operation. Also the speed at which the printing operation is carried out may affect the pressure and vice versa. Furthermore, the excitation of elements in the printing head may need to be modified in accordance with the thermal characteristics of the ink or the speed and the pressure with which the printing operation is carried out. In sum there are a number of variables that require adjustment either prior to or during the printing operation in order to produce a satisfactory graphic product.

Figure 17:
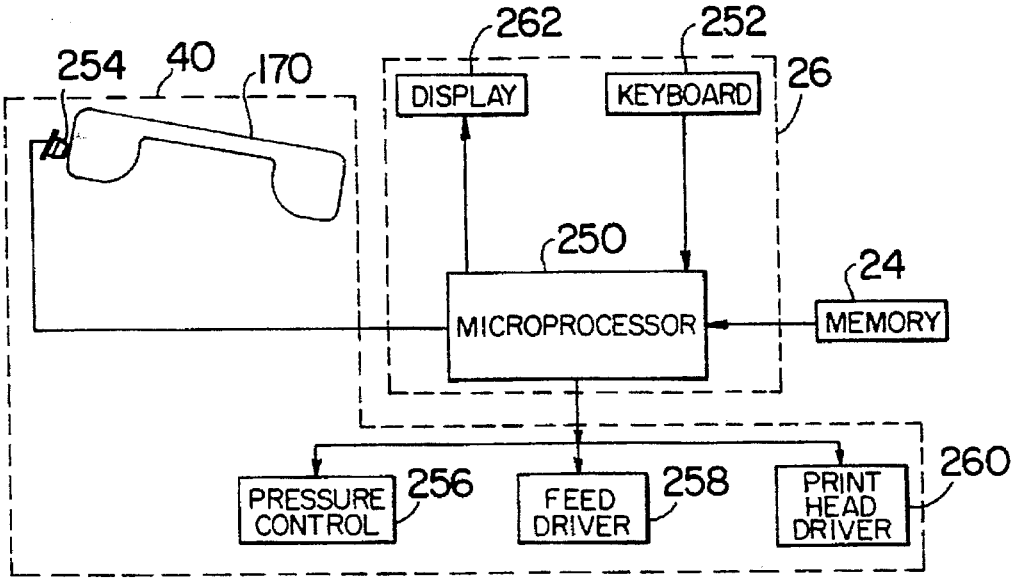
FIG. 17 is a schematic diagram illustrating the components that are responsible for controlling the various functions of the thermal printer in response to the coding on a donor web cassette.

For the reasons given above, the controller 26 of FIG. 1 shown in greater detail in FIG. 17 has a microprocessor 250 which regulates the operation of the printer 40 to set and adjust various of the operating parameters in a printing operation. The microprocessor responds to a number of inputs including the keyboard 252, the printing and cutting program derived from the memory 24 and a code reader 254 which detects printing characteristics of the web W and printing ink in the cassette 170. From these various inputs, the microprocessor regulates the pressure applied between the printing head 60 and roller platen 58 through the pressure control means 256 including the drive motor 138 and controlling cam 130 of FIG. 5, the speed of printing through the feed driver 258 which regulates the step motor 70 for the roller platen 58 in FIG. 6 and the image intensity through a print head drive 260 which controls the excitation of the heating elements in the print head 60. The setting of the various parameters and regulation during a printing operation is accomplished in conjunction with the display 262. In the event of a fault of the system, any error or detected fault is identified through the display 262 on the printer and if the fault is serious, the microprocessor immediately stops or inhibits printer operation.

Figure 10:
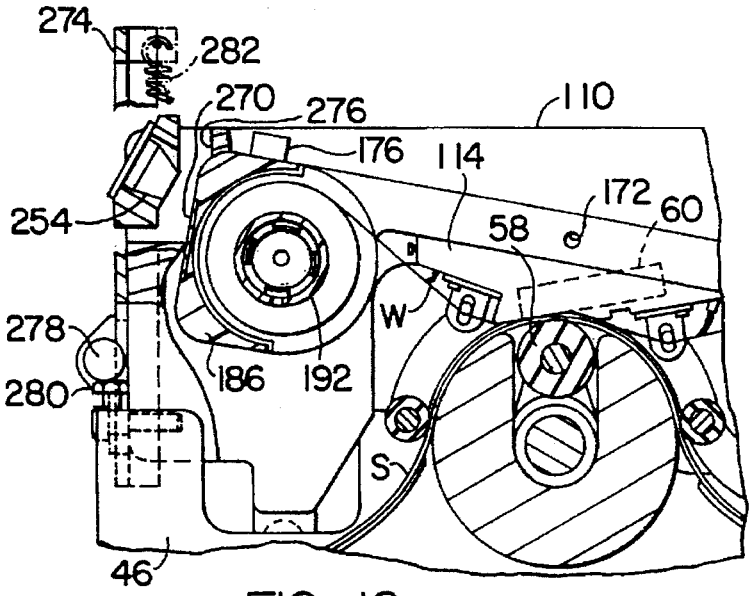
FIG. 10 is a fragmentary view similar to FIG. 9 after a code reading.
Figure 13:
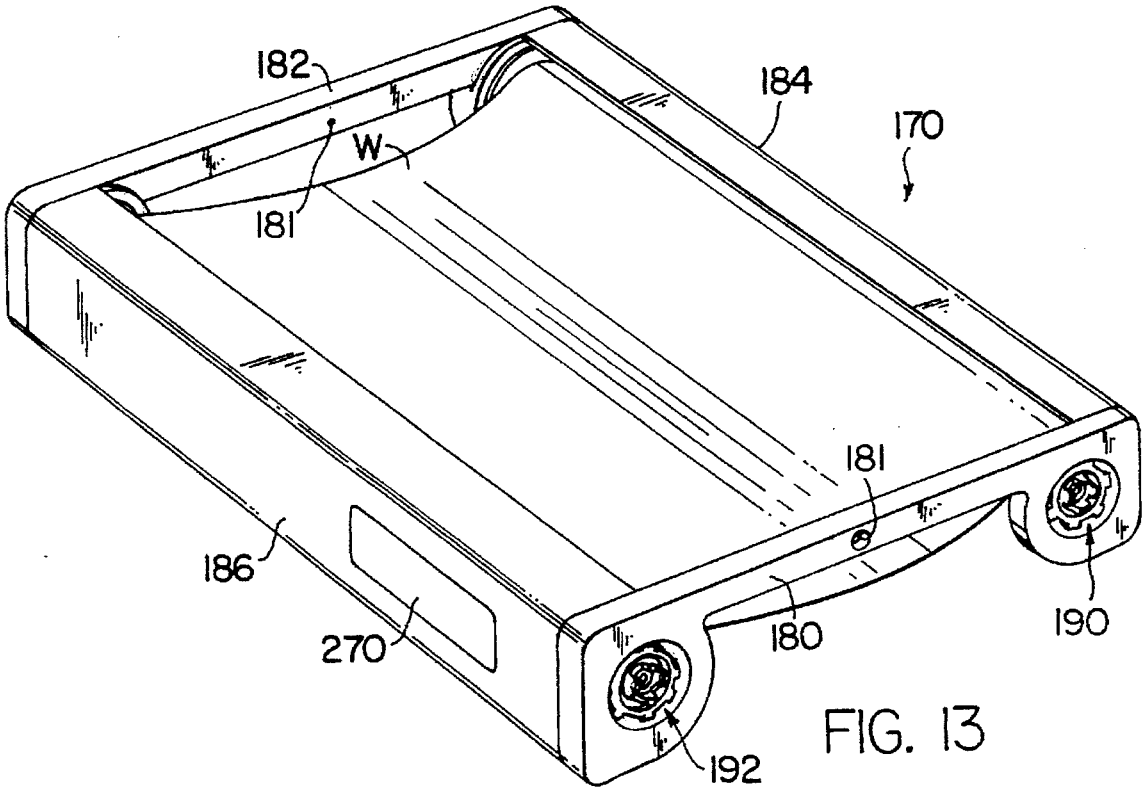
FIG. 13 is a perspective view of the cassette containing the donor web.
Figure 14:
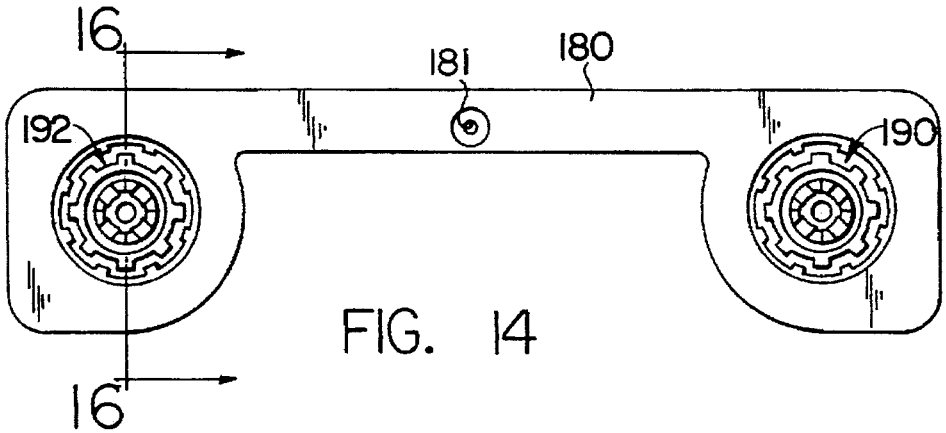
FIG. 14 is a side elevation view of the cassette in FIG. 13.
Figure 15:
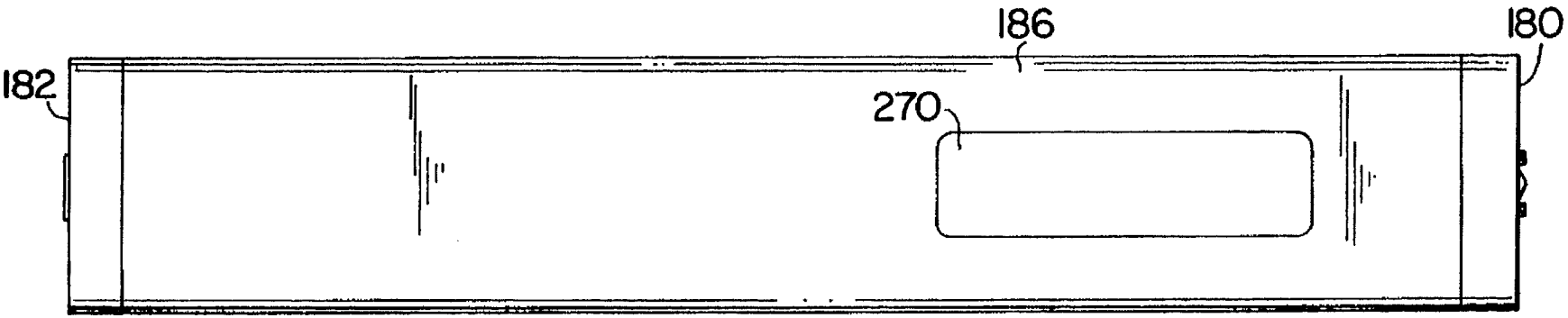
FIG. 15 is an end view of the cassette in FIG. 13 and shows the positioning of the label bearing the web coding.
Figure 16:
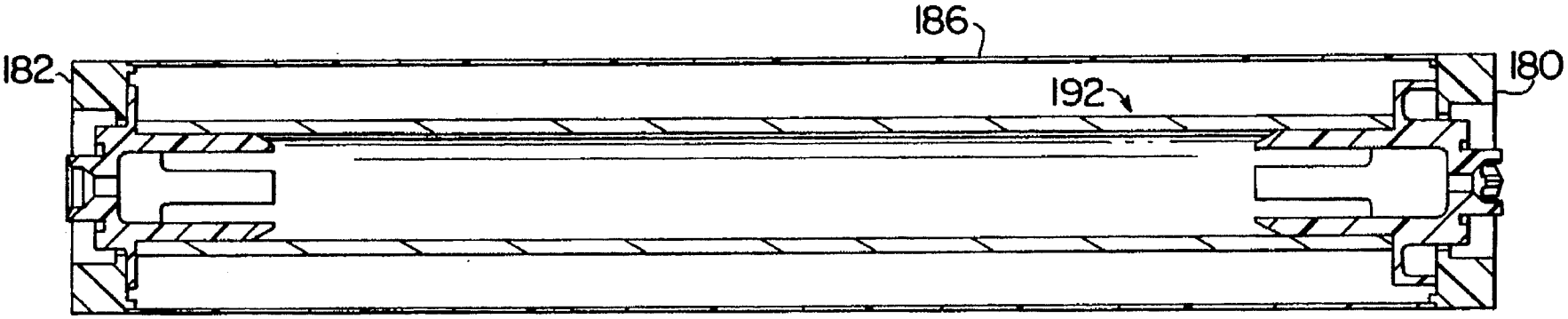
FIG. 16 is a cross-sectional view of the cassette as viewed along the line 16—16 in FIG. 14.

Since the donor web W is a significant variable in a printing operation and may be installed and replaced from time to time throughout a given operation in order to change the colors or other printing characteristics, a code label 270 bearing an identifying code is secured to the end shell 186 of the 45 cassette 170 adjacent the take-up reel 192 as shown in FIGS. 9, 10 and 13. The code label bears a code that identifies the color, thermal transfer and other distinctive printing characteristics of the donor web within the cassette. The printer includes the code reader or sensor 254 shown in FIGS. 9 and 10 for reading the code from the label 270 as the support frame 110 and the cassette 170 are moved by the pressure regulating means downwardly into an operative position in which the web and sheet material are pressed against the roller platen 58. FIG. 9 illustrates the relative positioning of the code label 270 and the code reader 254 immediately prior to a code reading operation, and FIG. 10 illustrates the relative positioning of the label 270 and reader 254 immediately after the reading operation. It is clear from the change in the relative positions that the code label 270 is swept past the reader 254 to read the identifying code on the label.

The mechanism that allows the identifying code to be swept includes the pressure regulating mechanism that pulls the support frame 110 and cassette 170 downwardly into the operative position and a slide plate 274 that is bolted to the projecting end of the support frame. 110 for sliding movement on the frame relative to the code label 270. The slide plate 274 positions the code reader 254 within a slot 276 in the end of the frame 110 directly opposite the code label 270 and includes an operating tang 278 which butts against an adjustable seat 280 on the housing 46 as the movable support frame 110 is lowered. A tension spring 282 connected at its upper end to the slide plate 274 and at its lower end to the frame 110 normally biases the plate 274 downwardly to the position illustrated in FIG. 9. However, when the tang abuts the seat 280 as shown in FIG. 10 and the support frame 110 continues its downward movement, the slide plate 274 moves upward relative to the frame 110 in opposition to the spring tension. During sliding movement of the plate the code reader 254 scans the code on the label 270 and transmits the read code back to the microprocessor 250 in FIG. 17.

The code reader 254 may be a magnetic, mechanical or other type of sensor but in the preferred embodiment the sensor is an optical sensor and the code on the label 270 is a compatible optically read code. One such code which is particularly suitable for the printer application is disclosed in FIG. 18 and includes a series of rectangular marks or bars that are located in at least one data track and one clocking track extending in the reading direction indicated by the arrow A. The outer tracks 290,292 in the illustrated embodiment are data tracks which are each divided into a series of data blocks, six blocks being illustrated in this embodiment. Each block represents a data bit and may be light or dark representing a "0" or a "1". Thus, for example, the data track 290 read in the direction of the arrow A would represent the binary number 100111. Correspondingly, the data track 292 would represent the binary number 001000. Both numbers may be components of a single number, and therefore, a total of $2^{12}$ or 4096 different codes can be derived from the two data tracks in combination.

The track 294 is a clocking track which controls the reading of the data tracks. The clocking track consists of a series of clocking marks which are read in the direction of the arrow A simultaneously with the two data tracks by a three head optical reader. The clocking track synchronizes the optical reading of the data blocks with the positioning of those blocks in front of an optical head within the reader 254. It will be noted, for example, that the clocking marks have the same dimensions as the data blocks but are offset from the data blocks by a half cycle in the reading direction. In reading the clocking marks, the transitions between light and dark values occur at the midpoint of the data blocks and by triggering the optical heads for the data blocks at the transitions, a clear and unambiguous reading of the data is taken.

It should be understood that the use of the clocking track in the code label renders the code reading process independent of any time clock within the microprocessor and independent of the speed with which the support frame 110 is moved downwardly into the operative position.

Figure 18:
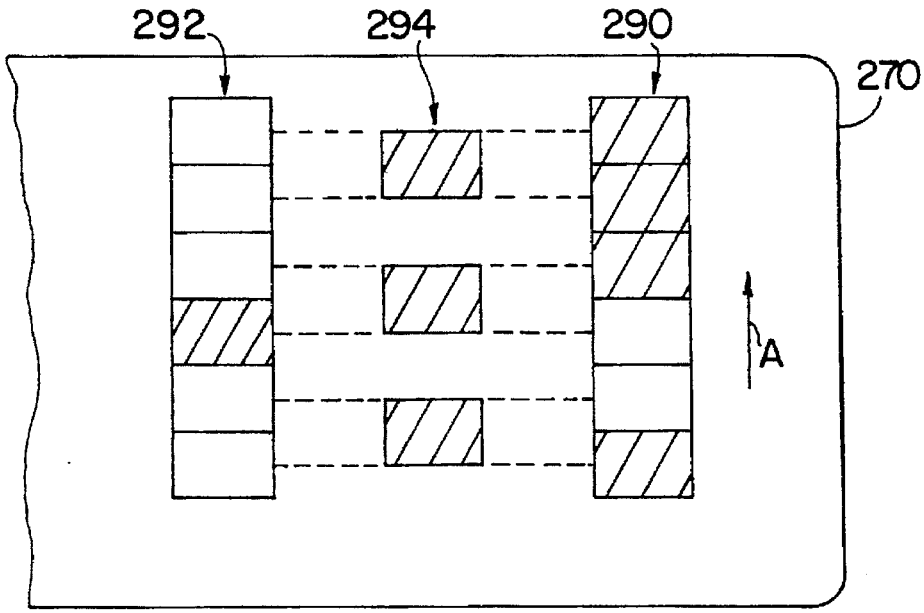
FIG. 18 illustrates the pattern of the coding on the cassette in one embodiment of the invention.

Additionally, the two data tracks 290.292 are located on opposite sides of the clocking track 294 to minimize any errors that may arise due to the mounting of the bar code label 270 at a slight angle to the direction of reading the code. Thus, the bar code illustrated in FIG. 18 is particularly useful for identifying donor webs bearing a transferrable printing ink that is used in thermal printers.

While the present invention has been described in a preferred embodiment, it should be understood that numerous modifications and substitutions can be had without departing from the spirit of the invention. For example, it is clear that the novel printing and cutting apparatus may be carried out by a number of different printing and cutting machines. The use of the common sprocket drive means in the printer and cutter ensures coordination between the printed and cut subject matter; however, other indicia including a timing track printed on the strip of sheet material to be printed upon may also be used for the same coordination. While a separate printer and cutter have been disclosed, it is contemplated that a single machine having interchangeable heads or both printing and cutting heads might be used to carry out the two functions. Wipers for cleaning the strip of sheet material before printing can also be provided. The thermal printer disclosed has a stationary printing head that extends parallel to the width of the strip of material on which the printing takes place; however, other types of printers including those with movable heads can also be employed. The control means disclosed regulates a number of the printing operations including the pressure applied by the printing head to the donor web and strip of sheet material resting on the printing platen. A number of the controls may be eliminated by selecting nominal values for the regulated parameters although the number of printing tasks that can be accomplished without such controls may be more limited. The coding employed to identify the type and characteristics of the donor web is advantageously applied to a cassette containing the web for scanning as the web moves into its operative position. Such coding, however, may take other forms and may be scanned by other techniques to accomplish the same or other control functions. Accordingly, the present invention has been described in several preferred embodiments by way of illustration rather than limitation.

We claim:

1. Printing apparatus for printing on a web of sheet material comprising:

a printing head;

feeding means for moving the printing head and a web of sheet material to be printed upon relative to one another while printing;

a donor web bearing a transfer ink, the donor web lying adjacent the web of sheet material while printing and movable by the feeding means with the web of sheet material relative to the printing head to transfer ink in a printed pattern onto the web of sheet material, the donor web being supported for movement with the web of sheet material by means of supply and take-up spools;

a drag brake mounted in the printer and connected with the supply spool for the donor web through a disengable coupling to maintain tension on the donor web during printing and to allow the donor web supply to be disengaged from the brake and removed from the printer; and feed detection means also connected with the supply spool for the donor web through the disengeable coupling for detecting a fault in the movement of the donor web relative to the printing head or the absence of the donor web while printing.

2. Printing apparatus as defined in claim 1 wherein the feed detection means is operatively connected with signaling means to signal a fault in movement or absence of the donor web when a fault is detected.

* * * * *